US007034781B2

(12) United States Patent
Irmer et al.

(10) Patent No.: US 7,034,781 B2
(45) Date of Patent: Apr. 25, 2006

(54) METHODS AND SYSTEMS FOR DRIVING DISPLAYS INCLUDING CAPACITIVE DISPLAY ELEMENTS

(75) Inventors: Frank Irmer, London (GB); Nicholas Ian Archibald, Herts (GB)

(73) Assignee: Elantec Semiconductor Inc., Milpitas, CA (US)

( * ) Notice: Subject to any disclaimer, the term of this patent is extended or adjusted under 35 U.S.C. 154(b) by 337 days.

(21) Appl. No.: 10/438,476

(22) Filed: May 15, 2003

(65) Prior Publication Data

US 2004/0160394 A1 Aug. 19, 2004

Related U.S. Application Data

(60) Provisional application No. 60/447,419, filed on Feb. 14, 2003.

(51) Int. Cl.
*G09G 3/30* (2006.01)

(52) U.S. Cl. ..... 345/76; 345/82

(58) Field of Classification Search ..... 345/76, 345/82

See application file for complete search history.

(56) References Cited

U.S. PATENT DOCUMENTS

| | | | | |
|---|---|---|---|---|
| 5,952,789 | A | 9/1999 | Stewart et al. | 315/169.4 |
| 6,104,361 | A | 8/2000 | Rutherford | 345/55 |
| 6,191,534 | B1 | 2/2001 | Schuler et al. | 315/169.3 |
| 6,201,522 | B1 | 3/2001 | Erhart et al. | 345/96 |
| 6,204,834 | B1 | 3/2001 | Baker et al. | 345/74 |
| 6,297,792 | B1 | 10/2001 | Takahashi | 345/91 |
| 6,342,881 | B1 | 1/2002 | Inoue | 345/204 |
| 6,356,253 | B1 | 3/2002 | Uchino et al. | 345/89 |
| 6,369,515 | B1 | 4/2002 | Okuda | 345/169.3 |
| 6,369,786 | B1 | 4/2002 | Suzuki | 345/77 |
| 6,407,732 | B1 * | 6/2002 | Stiens et al. | 345/204 |
| 6,426,744 | B1 | 7/2002 | Hashimoto et al. | 345/214 |

OTHER PUBLICATIONS

Landsburg, George, "Mixed-Signal Driver Chips For Emerging Displays," Clare Micronix, Jun. 29, 2001, 8 pp.
MXED102 240—Channel OLED Column Drive, product description from Clare Micronix, Jan. 16, 2002, 21 pp.
AN100.3—Using the MXED102 and MXED202, product description from Clare Micronix, Jan. 18, 2002., 11 pp.

* cited by examiner

*Primary Examiner*—Sumati Lefkowitz
*Assistant Examiner*—Ke Xiao
(74) *Attorney, Agent, or Firm*—Fliesler Meyer LLP

(57) ABSTRACT

Improved systems and methods are provided for driving a column of display elements having a parasitic capacitance. Following a light emitting phase in a row time period, the column is partially discharged. During an initial phase within a next row time period, the column of display elements is pre-charged, if a light emitting phase is to be performed within the next row time period. Otherwise, the column of display elements is further discharged if a light emitting phase is not to be performed within the next row time period.

33 Claims, 7 Drawing Sheets

METHODS AND SYSTEMS FOR DRIVING DISPLAYS INCLUDING CAPACITIVE DISPLAY ELEMENTS

PRIORITY CLAIM

This application claims priority to U.S. Provisional Patent Application No. 60/447,419, entitled "Methods and Systems for Driving OLED Displays," which was filed on Feb. 14, 2003.

FIELD OF THE INVENTION

The present invention relates to displays, and more specifically to methods and systems for driving displays.

BACKGROUND

Exemplary display driving systems and methods are discussed in the following references, each of which is incorporated herein by reference: U.S. Pat. No. 6,369,515 to Okuda, entitled "Display Apparatus with Capacitive Light-Emitting Devices and Method of Driving the Same"; (b) U.S. Pat. No. 6,369,786 to Suzuki, entitled "Matrix Driving Method and Apparatus for Current-Driven Display Elements"; and an article by George Landsburg for Clare Micronix, entitled "Mixed-Signal Drive Chips for Emerging Displays" copyright 2001.

New display technologies, such Organic Light Emitting Diode (OLED) technology, are based on thin organic light-emitting films. Like conventional inorganic light emitting diodes (LEDs), OLEDs require drive currents to produce bright visible light. However, unlike conventional LEDs, which have crystalline origins, thin film-based display elements (such as OLEDs) have area emitters that can be more easily patterned to produce flat-panel displays. Further, since these display elements are self-luminous, backlights may not be required, as is the case with liquid-crystal displays (LCDs).

Columns of OLEDs (or other similar display elements), which make up a display matrix, include parasitic capacitances (also known as an intrinsic capacitance) that must be taken into account when driving the columns. There is a need for low power and/or low cross-talk systems and methods that take into account such parasitic capacitances when driving matrix displays.

SUMMARY OF THE PRESENT INVENTION

Improved systems and methods for driving matrix displays are provided. The embodiments disclosed below provide for low power consumption and/or low cross-talk.

In accordance with certain embodiments of the present invention, during a pre-charge phase within a first row time period, the column of display elements are pre-charged. Following the pre-charge phase, during a light emitting phase within the first row time period, a light emitting current is applied to the column of display elements. Following the light emitting phase, during a partial-discharge phase within the first row time period, the column of display elements is partially discharged. During an initial phase within a second row time period immediately following the first row time period, the column of display elements is pre-charged, if a light emitting phase is to be performed within the second row time period. Otherwise, the column of display elements is further discharged (during the initial phase within a second row time period) if a light emitting phase is not to be performed within the second row time period.

Further and alternative features, as well as advantages, of various embodiments of the present invention are discussed below.

DETAILED DESCRIPTION OF INVENTION

Figure 1:
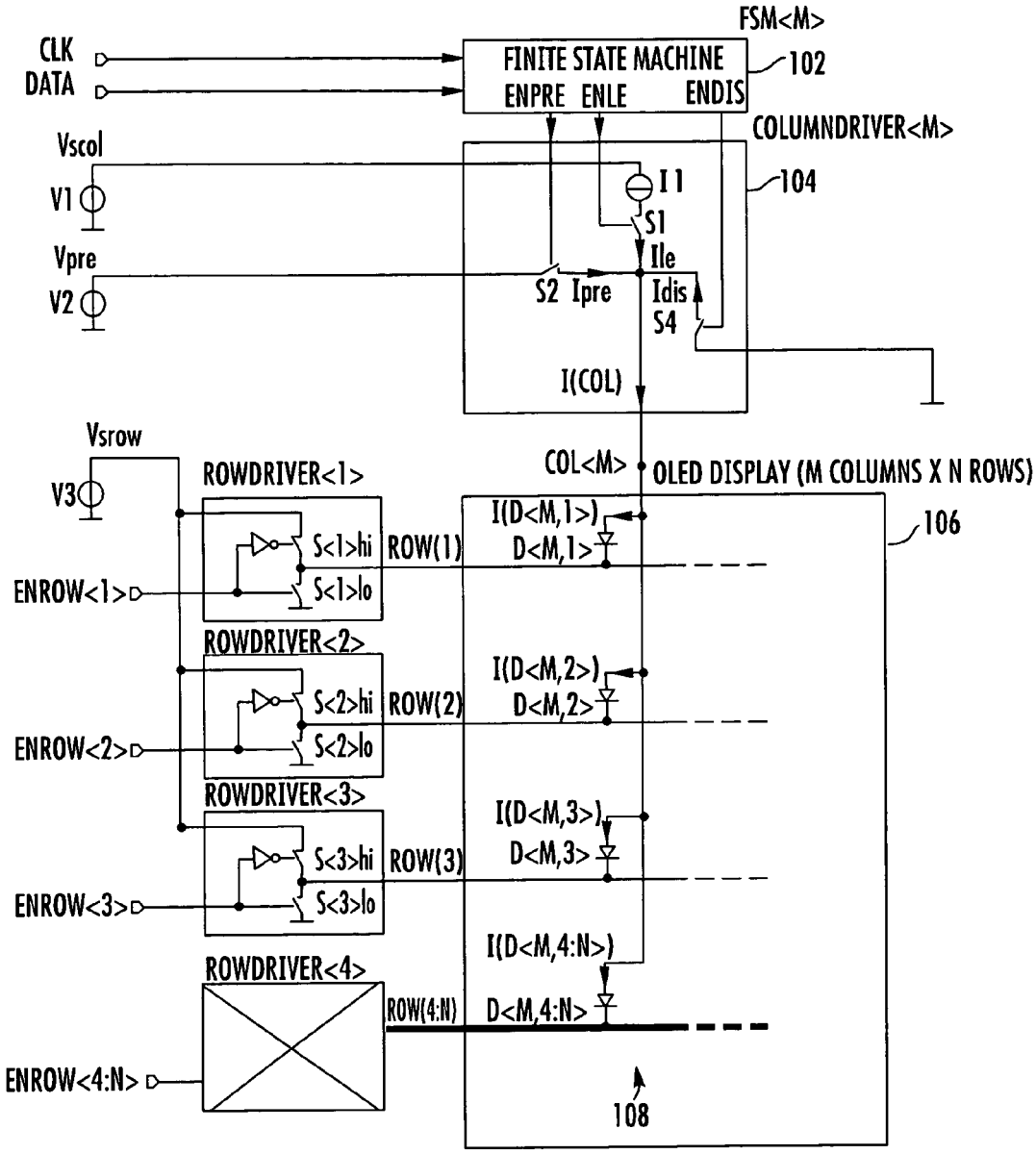
FIG. 1 (PRIOR ART)
FIG. 1 is a circuit diagram showing a prior art system that uses a switch (S4) to fully discharge a column to ground.
Figure 2:
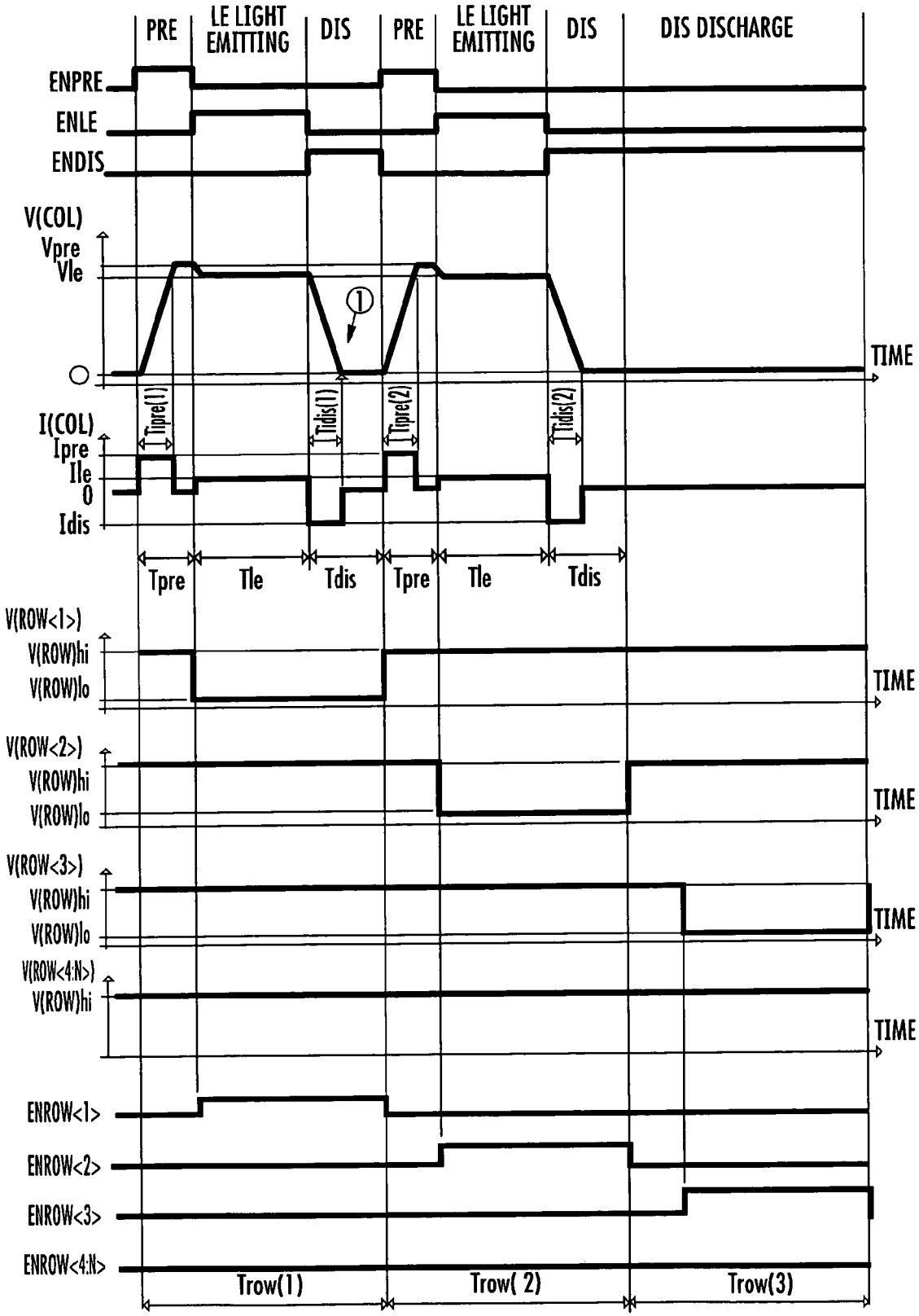
FIG. 2 (PRIOR ART)
FIG. 2 illustrates waveforms, associated with a prior art PRE/LE/DIS sequence.

Conventional systems and methods for driving a display column typically use a pre-charge (PRE) phase, followed by a light emitting (LE) phase, followed by a full discharge (DIS) phase, as shown in FIG. 2. An exemplary system for producing the waveforms of FIG. 2 is shown in FIG. 1.

Referring to FIGS. 1 and 2, the first three waveforms shown in FIG. 2, labeled ENPRE, ENLE and ENDIS, are the enable signals output by a finite state machine 102 shown in FIG. 1. The waveform labeled V(COL) in FIG. 2 is the voltage at the node labeled COL<M> in FIG. 1. The waveform labeled I(COL) in FIG. 2 represents the current output by an Mth column driver 104 shown in FIG. 1, which is provided to an Mth column 108 of an OLED display 106. The next four waveforms in FIG. 2, labeled V(ROW<1>), V(ROW<2>), V(ROW<3>) and V(ROW<4:N>), represent, respectively, the voltages at nodes ROW(1), ROW(2), ROW(3) and ROW(4:N) in FIG. 1, i.e., the voltage outputs of Row Drivers 1 through 4:N. The last four waveforms in FIG. 2, labeled ENROW<1>, ENROW<2>, ENROW<3> and ENROW<4:N>, represent, respectively, the inputs to Row Drivers 1 through 4:N. The exemplary OLED display 106 includes a matrix of M columns×N rows of OLEDs, with each column (e.g., the Mth column 108) including N OLEDs, as shown in FIG. 1. Each OLED, labeled D<M,1> though D<M,4:N> in column 108, includes a parasitic capacitance (also known as an intrinsic capacitance) that must be taken into account when driving the OLED column 108. For a more specific example, which is not meant to be limiting, a personal data assistant (PDA) device often includes 160×160 OLEDs. Each OLED in a matrix display is often referred to as a pixel.

Referring to FIG. 2, within each time period Trow(n), there is a pre-charge (PRE) phase, a light emitting (LE) phase and a discharge (DIS) phase. As can be appreciated from the waveform labeled V(COL) in FIG. 2, conventionally a column line voltage is fully discharged (typically to ground, so that V(COL)=0) during the discharge (DIS) phase at the end of a time period (e.g., at the end of time period Trow(1)). This is shown at labeled point ① in FIG. 2. This is inefficient, in that the column line voltage must be fully charged (i.e., re-charge or charged again) at an immediately succeeding time period where an OLED within the same column is to be turned on (e.g., at time period Trow(2)).

Embodiments of the present invention, which are described below with reference to FIGS. 3 and 4, increase energy efficiency (and reduce power consumption) by only partially discharging a column line voltage following a light emitting (LE) phase. Then, if an OLED within the same column is to be turned on during the immediately succeeding time period, a less power consuming pre-charge (PRE) phase can be used to appropriately pre-charge the column. More specifically, methods and systems, according to these embodiments of the present invention, drive an OLED display column using a drive waveform including a pre-charge (PRE) phase, followed by a light emitting (LE) phase, followed by a partial-discharge (PDIS) phase (to thereby "partially" remove charge stored in pixel parasitic capacitances), followed by a tri-state (TRI) phase, as shown in FIG. 4. The waveform labeled I(COL) in FIG. 4 shows the various phases used to drive the OLEDs with exemplary amplitudes (including polarity) and timing. As can be appreciated from the waveform labeled V(COL) in FIG. 4, a column line voltage is only partially discharged following the light emitting (LE) phase. This is shown at labeled point ② in FIG. 4.

Figure 3:
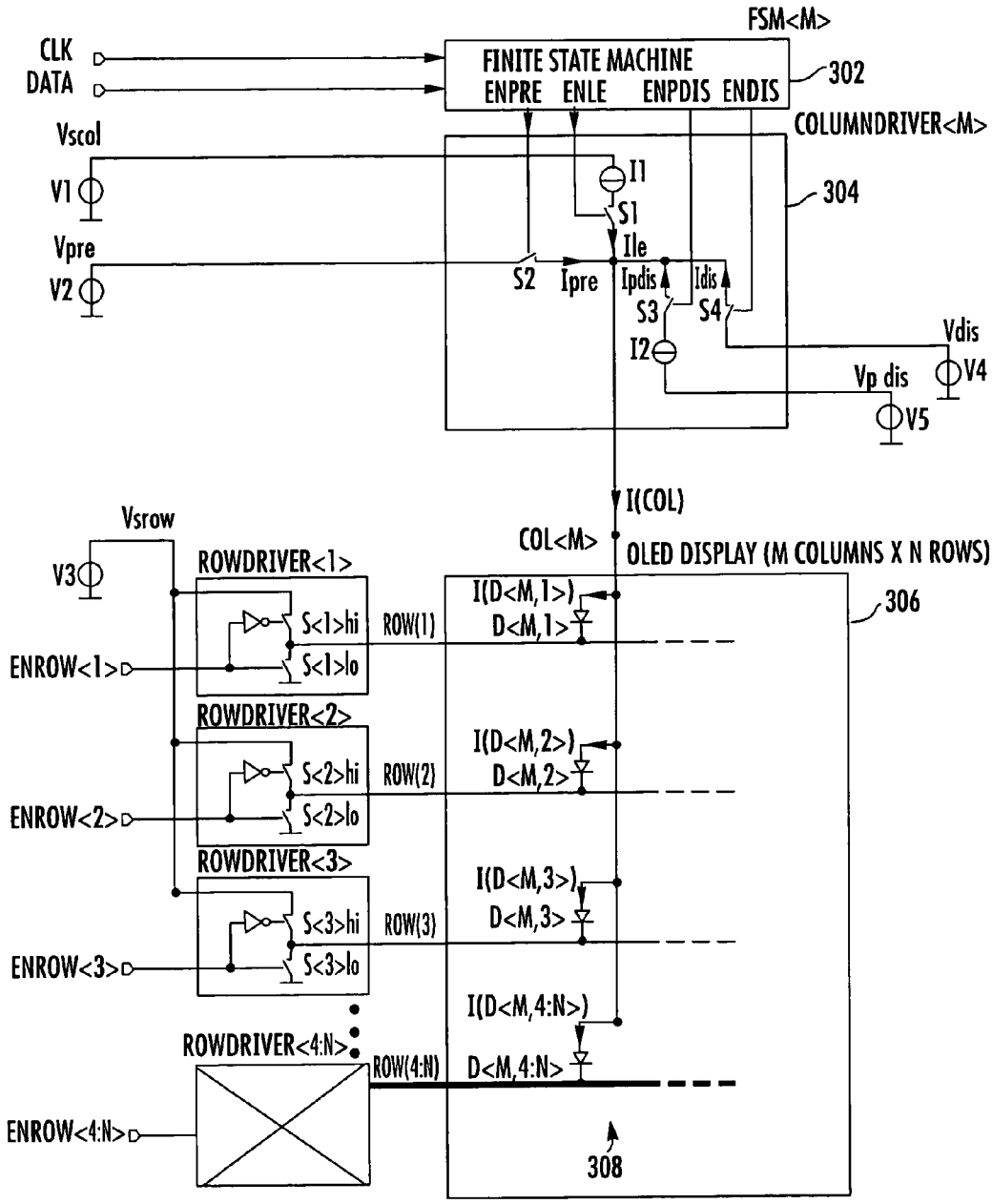
FIG. 3 is a circuit diagram, illustrating an embodiment of the present invention, which allows for the partial discharge of columns.
Figure 4:
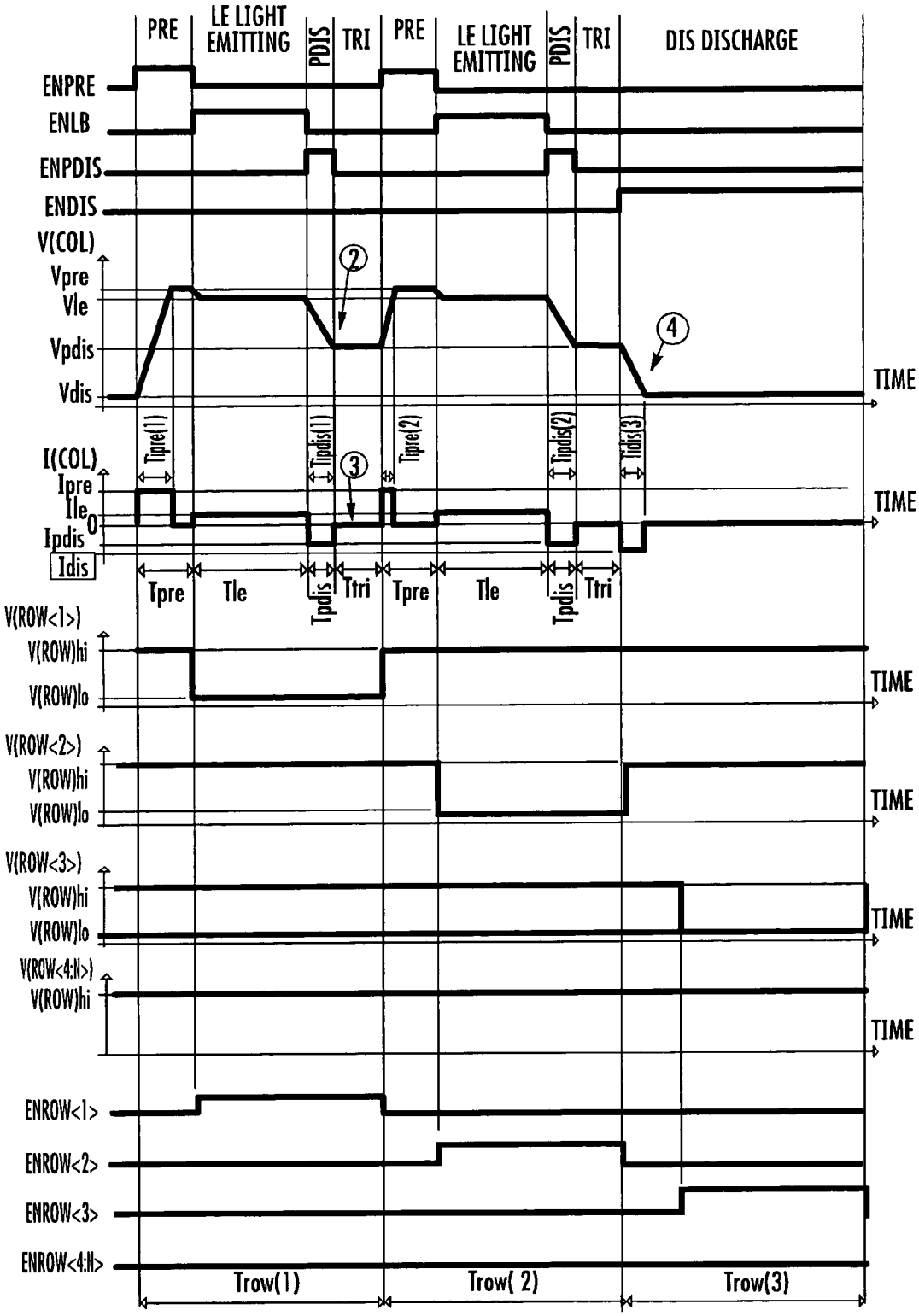
FIG. 4 illustrates waveforms associated with a PRE/LE/PDIS/TRI sequence in accordance with embodiments of the present invention; column- and row driver control and output waveforms show two row time periods with successive PRE/LE/PDIS/TRI phase sequences and one row time period with only a DIS phase.

FIG. 3 illustrates a system, according to an embodiment of the present invention, for producing the just described waveforms. According to an embodiment of the present invention, a finite state machine 302 is used to control the phase sequence and timing of these waveforms. Each column is likely, but not necessarily, controlled by its own finite state machine.

Referring to FIGS. 3 and 4, the first four waveforms shown in FIG. 4, labeled ENPRE, ENLE, ENPDIS and ENDIS, are the enable signals that are output by the finite state machine in FIG. 3. The waveform labeled V(COL) in FIG. 4 is the voltage at the node labeled COL<M> in FIG. 3. The waveform labeled I(COL) in FIG. 4 represents the current output by a column driver 304 shown in FIG. 3, which is provided to an Mth column 308 of an OLED display 306. The I(COL) waveform is also referred to as the current drive signal. The next four waveforms in FIG. 4, labeled V(ROW<1>), V(ROW<2>), V(ROW<3>) and V(ROW<4:N>), represent, respectively, the voltages at nodes ROW(1), ROW(2), ROW(3) and ROW(4:N) in FIG. 3, i.e., the outputs of Row Drivers 1 through 4:N. The last four waveforms in FIG. 4, labeled ENROW<1>, ENROW<2>, ENROW<3> and ENROW<4:N>, represent, respectively, the inputs to Row Drivers 1 through 4:N in FIG. 3. The term "4:N" is used to represent any row between a $4^{th}$ row and an $N^{th}$ row, inclusive, assuming the display includes four or more rows (e.g., N can be greater than or equal to 4). Of course, the present invention can be used with any size display, including displays in which the number of display elements can vary from column to column and/or from row to row.

Now specifically referring to FIG. 3, an exemplary embodiment of the column driver device 304 includes a current source I1 that can be enabled and disabled by a switch S1, which is controlled by the logic signal ENLE. The current source I1 is shown as being driven by a voltage source V1, which provides power for the current source. The switch S1 is connected between the current source I1 and node COL<M>. The column driver 304 is also shown as including a switch S2, controlled by logic signal ENPRE, to perform the pre-charge during the pre-charge (PRE) phase. The switch S2 is connected between the output of a voltage source V2 (which is used to produce the pre-charge voltage Vpre) and node COL<M>. The column driver also includes a pull down current source 12 that can be enabled and disabled with a switch S3, which is controlled by the logic signal ENPDIS, to perform the partial discharge during the PDIS phase. The switch S3 is connected between the output of the current source 12 and node COL<M>. Additionally, a switch S4 is used to perform the full discharge when no OLED within the column is to be turned on during a time period (e.g., during time period Trow(3) in FIG. 4)). The switch S4 is connected between a discharge voltage potential (shown as V4) and node COL<M>. In accordance with an embodiment of the present invention, the discharge voltage potential is ground. However, the discharge voltage potential need not be ground, but it should be less than the partial-discharge voltage (Vpdis) produced at node COL<M> during the PDIS phase. For example, the discharge voltage potential can alternatively be between ground and Vpdis, or it can even be a negative potential.

Figure 5:
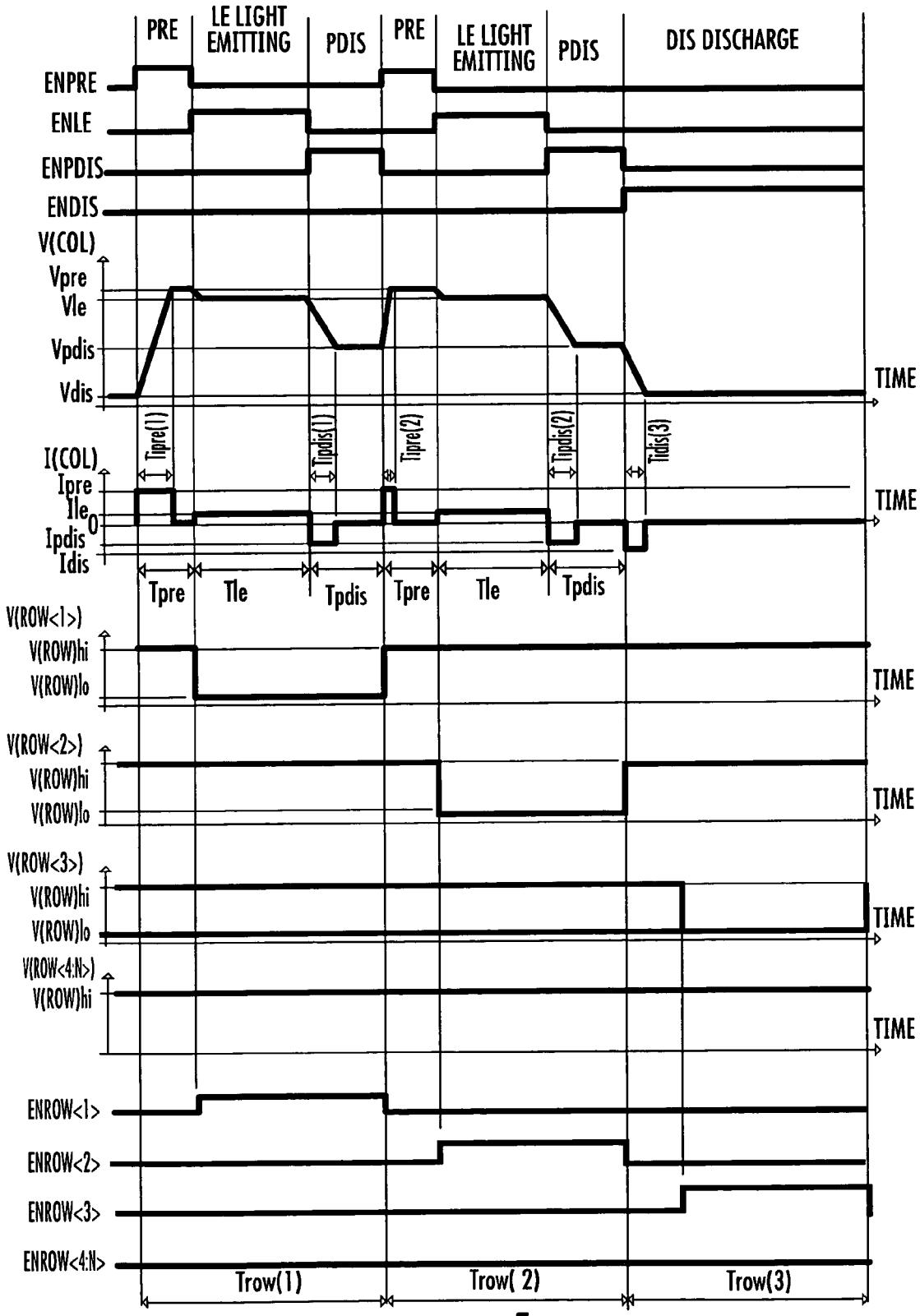
FIG. 5 illustrates waveforms associated with a PRE/LE/PDIS sequence, not containing any TRI phase, in accordance with alternative embodiments of the present invention; column- and row driver control and output waveforms that show two row time periods with successive PRE/LE/PDIS phase sequences and one row time period with only a DIS phase.
Figure 6:
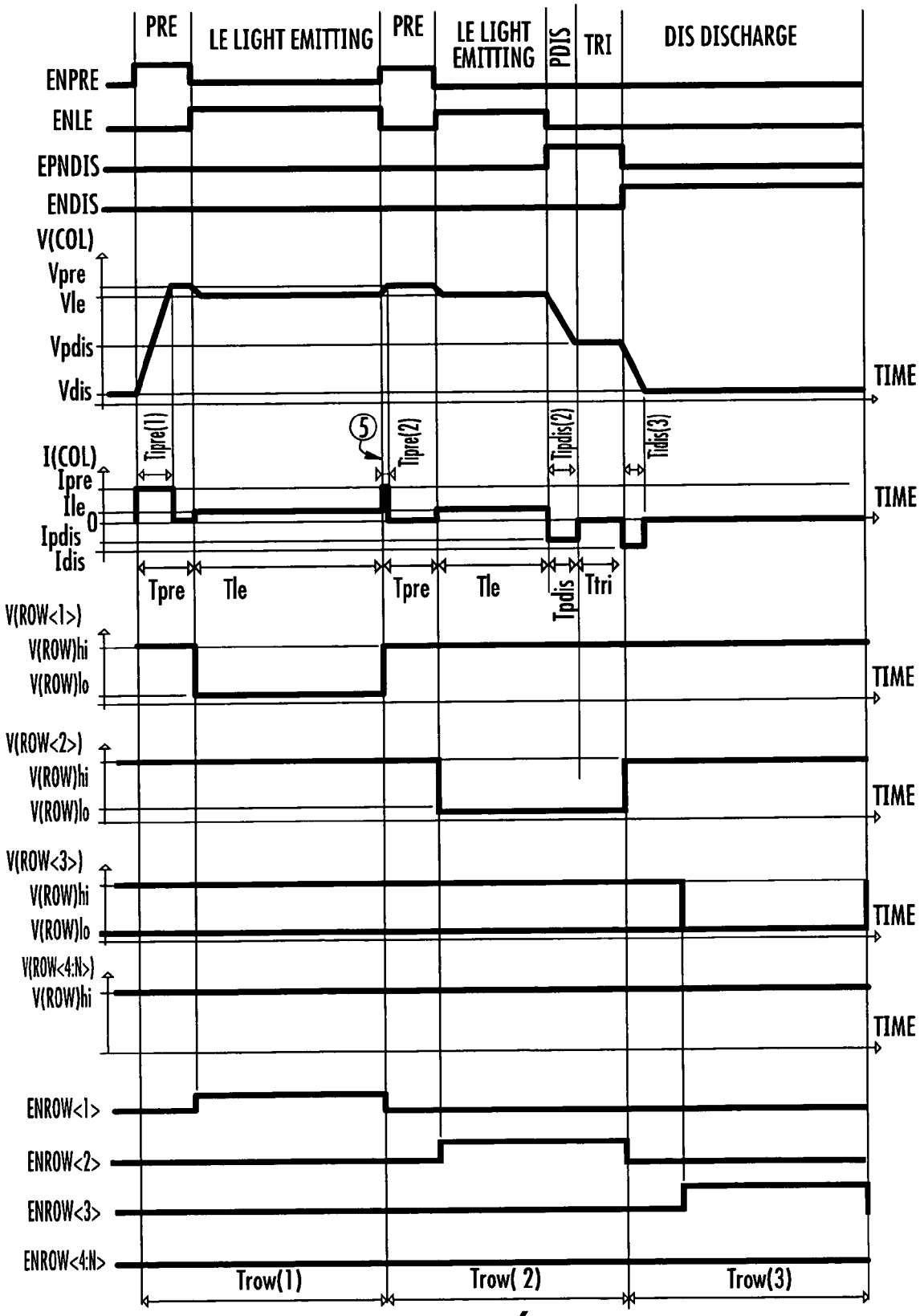
FIG. 6 illustrates waveforms associated with a PRE/LE/PRE sequence, not containing any DIS phase, in accordance with alternative embodiments of the present invention; column- and row driver control and output waveforms show one row time period with PRE/LE followed by one row time period with PRE/LE/PDIS/TRI phase sequence and one row time period with only a DIS phase.

Even though the pre-charge voltage (Vpre) is shown as being slightly greater than the light emitting voltage (Vle) in the waveform diagrams in FIGS. 4–6, it is noted that the pre-charge voltage (Vpre) can alternatively be equal to, or slightly less than, the light emitting voltage (Vle).

The current source I1 can be implemented, for example, using a P-channel transistor, with an appropriate voltage applied to its gate to get the desired output current. Similarly, the current source 12 can be implemented, for example, using an N-channel transistor, with an appropriate voltage applied to its gate to get the desired output current. However, the present invention is not limited to such embodiments. One of ordinary skill in the art would also appreciate that switches S1 through S4 can be implemented using various types of transistors.

The pre-charge (PRE) phase is used to deal with the collective intrinsic capacitances of the OLEDs (also referred to as pixels) in a column. The light emitting (LE) phase is used to purposely stimulate an OLED in a column. Where pulse width modulation (PWM) is used to control the brightness of a pixel, the length of the light emitting (LE) phase (i.e., Tle) is appropriately adjusted (based on display data) to give the desired brightness (i.e., to give the appropriate grey-scale). The partial-discharge (PDIS) phase is used to partially discharge intrinsic capacitances in a column, while still allowing for multiple grey-scales (also know as grayscales). For a column driver, the PDIS phase length (i.e., Tpdis) may be set as a constant. The tri-state (TRI) phase, which is when no current is output from the current driver 304, is used to make up the rest of a time period Trow(n), when Tpdis ends prior to the end of the Trow(n) (i.e., before the beginning of Trow(n+1)). However, it is noted that the Tpdis does not necessarily end prior to the end of the Trow. For example, in the case of a long LE phase where the Tpdis reaches the end of the Trow (not specifically shown in the FIGS.), no TRI phase will be used. The discharge (DIS) phase is used when no OLED in a column is to be stimulated during a time period (e.g., during Tidis(3) of Trow(3) in FIG. 4). As will be discussed below with reference to FIG. 6, both the PDIS phase and TRI phase may not be applied, in certain embodiments of the present invention.

Figure 7:
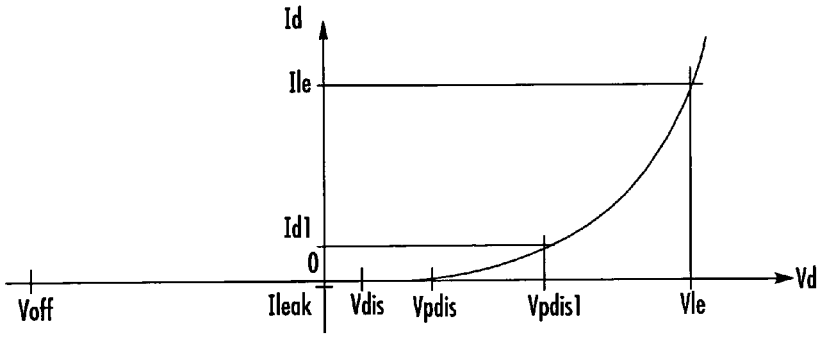
FIG. 7 is a graph illustrating characteristics of an exemplary OLED.

In accordance with embodiments of the present invention, during the tri-state (TRI) phase, no current flows in or out of the OLED column driver (e.g., OLED column driver 304), but current may flow through the OLEDs from the charge held by the intrinsic capacitance. For a given column voltage Vpdis1, the value of this current will be Id1 (see FIG. 7, which shows characteristics of an exemplary OLED). If given enough time, or discharged to a low enough voltage, Vpdis1 tends towards Vpdis, which can be significantly greater than zero, and current Id1 tends towards zero, essentially maintaining a constant voltage on the column for the rest of the row time period Trow. By maintaining the column line voltage charge that exists following the partial-discharge (PDIS) phase, the charge can be reused in the following pre-charge (PRE) phase (allowing for a shorter and thus lower power consuming PRE phase). For the column driver device 304 shown in FIG. 3, this is accomplished by opening all four switches S1, S2, S3 and S4 so that there is no active current drive on the node that is common to the four switches (i.e., no active current drive on node COL<M>). In other words, the drive current I(COL) is zero during the TRI phase, as seen at labeled point ③ in FIG. 4.

In the above discussion of the column driver 304 in FIG. 3, switch S2 was described as being connected between the output of the voltage source V2 and node COL<M>, to produce the pre-charge voltage Vpre at the node COL<M>. In accordance with alternative embodiments of the present invention, switch S2 is connected between a pull-up current source (not shown) used to pre-charge the column 308 when the switch S2 is closed. In other words, switch S2 is closed for the period of time necessary to produce Vpre at node COL<M>, and then opened.

Also in the above discussion of the column driver 304, switch S3 was described as being connected between the output of pull-down current source 12 and node COL<M>, for use during the partial discharge phase. In accordance with alternative embodiments of the present invention, switch S3 is connected between a partial discharge voltage source and node COL<M>, to selectively provide the partial-discharge voltage (Vpdis) at node COL<M>. In these alternative embodiments, switch S3 can remained closed even after node COL<M> reaches the desired partial-discharge voltage (Vpdis). Thus, in these embodiments, there is no need for a tri-state phase. Rather, the partial-discharge phase can extend to the end of the row time period, as shown in row time periods Trow(1) and Trow(2) in FIG. 5.

In the above discussions of the column driver 304, switch S3 is closed (during the PDIS phase), to partially discharge column 308, and switch S4 is closed (during the DIS phase) to further discharge column 308. In accordance with alternative embodiments of the present invention, a single switch is used in place of the two separate switches S3 and S4. This single switch is connected between a pull down current source and node COL<M>. The voltage produced at node COL<M> in response to the single switch being closed will be directly proportional to the pull down current (produced by the pull down current source) and the amount of time the switch is closed. Accordingly, the single switch can be closed for a first amount of time (e.g., 3 usec) to partially discharge the column 308 during the PDIS phase. The single switch can thereafter (in a next row time period) be closed for a further amount of time to further discharge the column 308 during the DIS phase. Alternatively, or additionally, the magnitude of the pull-down current (produced by the pull-down current source connected to the single switch) can be varied to produce the desired voltages Vpdis and Vdis during the PDIS and DIS phases, respectively.

In FIGS. 1 and 3, the Row Drivers 1 through 4:N are shown as being driven by a voltage source V3, which outputs a voltage Vsrow. The logic enable lines ENROW<1> through <4:N> control switches within the Row Drivers so that each Row Driver provides either a HI or a LOW signal to all the cathodes of the OLEDs in its respective row. The anodes of all the OLEDs in a single column (e.g., column <M>) are connected to the same node (e.g., node COL<M>). This arrangement is such that the stimulated OLED is the OLED at the column/row cross-point where COL<M> is HIGH, and ROW<n> is LOW (where n is an integer representing a row number). Thus, looking at the waveforms in FIGS. 2 and 4, during a first time period Trow(1), the OLED in the $1^{st}$ row of the Mth column is stimulated to turn on (i.e., turned on); during a second time period Trow(2), the OLED in the $2^{nd}$ row of the Mth column is turned on; and during a third time period Trow(3), no OLED in the Mth column is turned on. However, embodiments of the present invention are not meant to be limited to this exact arrangement.

As previously mentioned, the above described embodiments of the present invention use a partial discharge (PDIS) phase to increase energy efficiency (and reduce power consumption) when the column line voltage is charged at the immediately succeeding row time period (i.e., when an OLED within the same column is turned on in the immediately succeeding row time period). However, it should be noted that the column line voltage is still discharged (following the PDIS phase) using a discharge (DIS) phase, where no OLED in that column is to be turned on during the immediately succeeding time period. This is shown, for example, at labeled point ④ in FIG. 4. The column line voltage (e.g., the voltage at node COL<M>) at the end of the DIS phase should be low enough that light is not emitted from a display element in the column when the DIS phase is complete. But, as mentioned above, Vdis need not be equal to ground. Vpdis, which is between Vdis and Vle, is preferably low enough that only minimal light may be emitted from a display element in the column when the PDIS phase is complete.

The resultant partial discharge voltage (Vpdis), produced in accordance with embodiments of the present invention, can be approximately defined by the column voltage during the light emitting (LE) phase (Vle), the column capacitance (Ccol), the partial discharge time (Tpdis) and the partial discharge current value (Ipdis). This is shown below in Equation 1. It is noted that the terms "time" and "phase length" are used interchangeably herein.

Equation 1:

$$Vpdis = Vle - \frac{Tpdis \cdot Ipdis}{Ccol}$$

where,

Vpdis=resultant partial discharge voltage;

Ccol=column capacitance=number of rows×pixel capacitance=N(ROW)×Cpix;

Vle=column voltage during the light emitting (LE) phase;

Tpdis=partial discharge time; and

Ipdis=partial discharge current.

In the above Equation 1, Vpdis can be adjusted as desired by varying Tpdis and/or Ipdis. Alternatively, a user may want to always have the same Vpdis for a given Vle. The user may also want to adjust for changes in Vle (which varies with light emitting current Ile and temperature), thus using Tpdis and/or Ipdis for dynamic adjustments. Alternatively, if the user wants Vpdis to be dependent on pulse width modulation (PWM) data values, then Tpdis and/or Ipdis value(s), with a fixed relation to the changing PWM data value, can be applied.

Power consumption is one of the main design criteria in most portable and handheld systems (e.g., personal data assistants (PDAs) and mobile phones). Embodiments of the present invention lead to less power consumption in OLED display driver systems, and thus, are very useful for handheld systems. However, embodiments of the present invention are not limited thereto. The Equations and example calculations shown below are used to illustrate the power consumption savings that can be achieved using embodiments of the present invention. Symbols and typical values (which are used in the power calculations) are shown below:

f(ROW)=1/Trow=Row Frequency

Vscol=Supply Voltage=12V

Vpre=Pre-Charge Voltage=10V

Vie=Light Emitting Voltage=10V

Ile=Light Emitting Current=200 uA

Vpdis=Partial Discharge Voltage=5V

Tle=Light Emitting Phase Time=25 us f(ROW)=Row Frequency=16 KHz

Cpix=Pixel Capacitance=30 pF

Nrow=Number of Rows=160

Ncol=Number of Columns=160

Equations 2 through 4 below are used to show examples of power consumption, when using the conventional systems and methods described with reference to FIGS. 1 and 2. Equation 2 is used to calculate the average power consumption in voltage source V1 (Light Emitting) with a light emitting time (Tle) applied to all pixels in the display. Equation 3 is used to calculate the average power consumption in voltage source V2 (Pre-Charge). Equation 4, which simply adds the results of Equations 2 and 3, is used to show the total power consumption, when using the conventional systems and methods described with reference to FIGS. 1 and 2.

Equation 2:

$$\begin{aligned} Ple &= Vscol \cdot Ile \cdot Tle \cdot f(ROW) \cdot Ncol \\ &= 12\ \text{V} \cdot 200uA \cdot 25us \cdot 16\ \text{KHz} \cdot 160 \\ &= 0.154\ \text{W} \end{aligned}$$

Equation 3:

$$\begin{aligned} Ppre(DIS/PRE) &= Vscol \cdot Cpix \cdot Vpre \cdot f(ROW) \cdot Ncol \cdot Nrow \\ &= 12\ \text{V} \cdot 30\ \text{pF} \cdot 10\ \text{V} \cdot 16\ \text{KHz} \cdot 160 \cdot 160 \\ &= 1.475\ \text{W} \end{aligned}$$

-continued

Equation 4:

$$\begin{aligned} Ptotal(priorArt) &= Ppre(DIS/PRE) + Ple \\ &= 1.475\ \text{W} + 0.154\ \text{W} \\ &= 1.629\ \text{W} \end{aligned}$$

Additional Equations 5 and 6 below are used to show examples of power consumption, when using the embodiments of the present invention described with reference to FIGS. 3 and 4. The average power consumption in voltage source V1 (Light Emitting) with a light emitting time (Tle) applied to all pixels in the display is substantially the same for the present invention as in the conventional systems (so the example result of Equation 2 applies). Equation 5 is used to calculate the average power consumption in voltage source V2 (Pre-Charge) when the invented phase sequence (including PDIS/TRI/PRE) of the present invention is continuously applied. Equation 6, which simply adds the results of Equations 2 and 5, is used to show the total power consumption, when using the systems and methods of the present invention described with reference to FIGS. 3 and 4.

Equation 5:

$$\begin{aligned} Ppre(PDIS/TRI/PRE) &= Vscol \cdot Cpix \cdot (Vpre - Vpdis) \cdot f(ROW) \cdot Ncol \cdot Nrow \\ &= 12\ \text{V} \cdot 30\ \text{pF} \cdot (10\ \text{V} - 5\ \text{V}) \cdot 16\ \text{KHz} \cdot 160 \cdot 160 \\ &= 0.737\ \text{W} \end{aligned}$$

Equation 6:

$$\begin{aligned} Ptotal(\text{invention}) &= Ppre(PDIS/TRI/PRE) + Ple \\ &= 0.737\ \text{W} + 0.154\ \text{W} \\ &= 0.891\ \text{W} \\ &[= 55\%\ \text{of}\ Ptotal(\text{prior art})] \end{aligned}$$

An advantage of embodiments of the present is that at the end of the PDIS/TRI phase sequence, a defined voltage (see Equation 1) on the column line remains as an initial condition for a following pre-charge (PRE) phase. This leads to a shorter pre-charge current time (Tpre) and therefore significantly less pre-charge power consumption (see Equations 1 to 6).

Another advantage of embodiments of the present invention is that partial discharge voltage can be reliably set and dynamically varied by controlling the current value Ipdis and the length of the partial discharge phase Tpdis for a given OLED display panel, to thereby adjust for OLED display temperature variations.

A further advantage of embodiments of the present invention is that the amount of cross-talk can be adjusted to best compromise between cross-talk artifacts in neighbor columns and grey-scale resolution for dark grey pixels.

Additional embodiments of the present invention will now be described with reference to FIG. 6. It is noted that the column driver 304 shown in FIG. 3 can also be used to produce the waveforms in FIG. 6. In these embodiments, where an OLED within the same column is going to need to be turned on in the next time period (Trow(n)), there is no partial-discharge (PDIS) phase and no tri-state (TRI) phase.

These embodiments are even more energy efficient, because of the minimal time a pre-charge current is applied during the pre-charge (PRE) phase following a light emitting (LE) phase (this is shown at labeled point ⑤ in FIG. 6). However, the I(COL) and V(COL) waveforms of FIG. 6 do not allow for grey-scales, since the OLEDs in this embodiment will operate at, or close to, maximum brightness. Accordingly, these embodiments of the present invention are most practical where the use of grey-scales are not important, but minimal power consumption is important. These embodiments are also useful for saving power consumption in implementations where grey-scales are used, if a pixel is at maximum brightness for a current row time period, and will be emitting any level of light in the next row time period. Note that the PDIS phase, TRI phase, as well as the compete discharge (DIS) phase can be used at later time periods, as shown in FIG. 6. In other words, the embodiment where PDIS and TRI phases are skipped, can be combined with embodiments where PDIS and TRI phases are applied.

Although not preferably, it is noted that a column need not be pre-charged prior to a light emitting phase. In other words, the use of pre-charge (PRE) phases can be skipped in each of the above described embodiments. Accordingly, the LE phase may be immediately preceded by either a PDIS phase, a DIS phase, or a previous LE phase, and immediately proceeded by either a PDIS phase, a DIS phase, or another LE phase. Also, as noted above, it is possible to skip or not use the TRI phase.

In FIGS. 1–5, and the above Equations 1–6, the following naming conventions have been used:

Logic Signals
ENPRE=Enable Pre-Charge
ENLE=Enable Light Emitting
ENDIS=Enable Discharge
ENPDIS=Enable Partial Discharge
ENROW=Enable Row Phase Names
PRE=Pre-Charge Phase
LE=Light Emitting Phase
DIS=Discharge Phase
PDIS=Partial Discharge Phase
TRI=Tri-State Phase Timings
Tpre=Given Pre-Charge Phase Time
Tle=Given Light Emitting Phase Time
Tdis=Given Discharge PhaseTime
Tpdis=Given Partial Discharge Phase Time
Ttri=Given Tri-State Phase Time
Trow=Given Row Cycle Time
Tipre( )=Resulting Pre-Charge Current Time
Tidis( )=Resulting Discharge Current Time
Tipdis( )=Partial Discharge Current Time=Tpdis Voltages
Vpre=Resulting Pre-Charge Voltage
Vle=Resulting Light Emitting Voltage
Vpdis=Resulting Partial Discharge Voltage
V(ROW)hi=Row high voltage
V(ROW)lo=Row low voltage
0=Ground Currents
Ipre=Current during Resulting Pre-Charge Time
Ile=Current in Light Emitting Phase (Tle)
Idis=Current during Tidis( )
Ipdis=Current during Tipdis( )

Using the present display technology, OLED displays are connected in matrices with the OLED anodes connected to the columns and the OLED cathodes connected to the rows, as discussed above with reference to FIGS. 1 and 3. Due to the low resistant path of the material used to create the rows, driving schemes described above rely on using a simple row driver to select the row to be driven and a column driver to provide picture information to be displayed to each individual column. The embodiments of the present invention, as described above, use such a scheme. However, should display technology evolve to allow columns to be manufactured out of low resistance material, it would be possible to implement the driving the other way round. This would involve selecting one column at a time and writing the image content via the rows. In order to do this, the signals applied to the rows (ROW<1:N>, where there are N rows) would be swapped with the signals applied to the columns (COL<1:M> where there are M columns) and the polarity of all signals would be inverted. The row time period described above would have to be described as the column time period. This modified scheme would require that the columns be held at a low voltage normally and then taken to a higher voltage during the active column time (this is simply the inverted row signal of the invented schemes described above). Additionally, a row would be held at high voltage normally (when not emitting light). During the pre-charge (PRE) phase, a row would be pre-charged to a lower voltage if light is to be emitted during a column time period. A row would be stimulated to emit light by drawing a current out of the row, thus producing a light emitting voltage on the row. A row would be partially discharged by charging the row to a partial discharge voltage higher than the light emitting voltage, and further discharged to a voltage higher than the partial discharge voltage. This is simply an inverted version of the column drive schemes described in detail above. It is intended that such inverted schemes are also within the spirit and scope of the present invention.

OLEDs are alternatively referred to as organic electroluminescence (EL) elements. The above described embodiments of the present invention have been mainly described as being useful for driving OLEDs and OLED displays. However, these embodiments of the present invention are also useful for driving any other type of current driven display elements that have parasitic capacitance. Accordingly, the embodiments of the present invention are not limited to use with OLEDs and OLED displays. Plasma displays also produce parasitic capacitances. Accordingly, embodiments of the present invention may also be useful with plasma displays. The above list is not meant to be limiting.

The forgoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. It is intended that the scope of the invention be defined by the following claims and their equivalent.

What is claimed is:

1. A method for driving a column of display elements having a parasitic capacitance, the method comprising:

(a) during a pre-charge phase within a first row time period, pre-charging the column of display elements;

(b) following the pre-charge phase, during a light emitting phase within the first row time period, applying a light emitting current to the column of display elements;

(c) following the light emitting phase, during a partial-discharge phase within the first row time period, partially discharging the column of display elements; and (d) during an initial phase within a second row time period immediately following the first row time period, pre-charging the column of display elements if a light emitting phase is to be performed within the second row time period, otherwise further discharging the column of display elements if a light emitting phase is not to be performed within the second row time period.

2. The method of claim 1, wherein the initial phase within the second row time period immediately follows the partial-discharge phase within the first row time period.

3. The method of claim 1, wherein a tri-state phase occurs between the partial-discharge phase within the first row time period and the initial phase within the second row-time period, the tri-state phase being within the first row time period.

4. The method of claim 1, wherein:

step (a) includes applying a pre-charge current or a pre-charge voltage source to a node that is common to an anode of each display element in the column of display elements, to thereby produce a pre-charge voltage (Vpre) at the node;

step (b) includes applying a light emitting current to the node, thereby producing a light emitting voltage (Vle) at the node;

step (c) includes applying a partial-discharge current or a partial-discharge voltage source to the node, the thereby produce a partial-discharge voltage (Vpdis) at the node, the partial-discharge voltage (Vpdis) being less than the light emitting voltage (Vle); and step (d) includes:

applying the pre-charge current or the pre-charge voltage source to the node if a light emitting phase is to be performed within the second row time period, to thereby produce the pre-charge voltage (Vpre) at the node, the pre-charge voltage (Vpre) being greater than the partial discharge voltage (Vpdis); otherwise applying a discharge current or a discharge voltage source to the node if a light emitting phase is not to be performed within the second row time period, to thereby produce a discharge voltage (Vdis) at the node, the discharge voltage (Vdis) being less then the partial discharge voltage (Vpdis).

5. The method of claim 4, further comprising: between steps (c) and (d), during a tri-state phase within the first row time period, following the partial-discharge phase within the first row time period, applying no current from a column driver to the node.

6. The method of claim 4, wherein step (d) includes applying a discharge voltage source to the node if a light emitting phase is not to be performed within the second row time period, the discharge voltage being selected from a group consisting of:

ground;

a voltage supply level slightly above ground; and a voltage supply level slightly below ground.

7. A method for driving a column of display elements having a parasitic capacitance, comprising:

(a) following a light emitting phase, where a display element in the column is selected to emit light, partially discharging the column; and (b) after the column is partially discharged, either further discharging the column or pre-charging the column, depending on whether a display element in the column is to be selected to emit light during a next row time period.

8. The method of claim 7, wherein step (b) includes:

(b.1) if a display element in the column is not to be selected to emit light during the next row time period, further discharging the column; otherwise (b.2) if a display element in the column is to be selected to emit light during the next row time period, pre-charging the column from a partial-discharge voltage (Vpdis) to a pre-charge voltage (Vpre), thereby preparing for a further light emitting phase during the next time period.

9. A method for driving a column of display elements having a parasitic capacitance, comprising:

(a) following a light emitting phase, where a display element in the column has been selected to emit light, partially discharging the column; and (b) after the column is partially discharged, further discharging the column during a next row time period if a display element in the column is not to be selected to emit light during the next row time period.

10. The method of claim 9, wherein step (b) includes, if a display element in the column is to be selected to emit light during the next row time period, applying a light emitting current to the column during the next row time period.

11. In a system including a column driver having an output connected to a column of display elements having a parasitic capacitance, a method for driving the column of display elements, comprising:

(a) following a light emitting phase within a row time period, where the column driver provided a light emitting current to the column, providing a partial-discharge current or a partial-discharge voltage from the column driver to the column during a partial-discharge phase within the row time period;

(b) if the partial-discharge phase ends prior to an end of the row time period, applying no current from the column driver to the column during a tri-state phase that comprises a remainder of the row time period; and (c) after the row time period, either applying a discharge current or voltage, or a pre-charge current or voltage, from the column driver to the column, depending on whether the column driver is to provide the light emitting current to the column during a next row time period.

12. The method of claim 11, wherein step (c) includes:

(c.1) if the column driver is not to provide the light emitting current to the column during the next row time period, applying the discharge current or voltage; otherwise (c.2) if the column driver is to provide the light emitting current to the column during the next row time period, applying the pre-charge current or voltage.

13. A column driver adapted to drive a column of display elements having a parasitic capacitance, comprising:

a first switch adapted to provide a light emitting current to an output of the column driver, when the first switch is selected to be closed;

a second switch adapted to provide a pre-charge current or voltage to the output of the column driver, when the second switch is selected to be closed;

a third switch adapted to provide a partial-discharge current or voltage to the output of the column driver, when the third switch is selected to be closed; and a fourth switch adapted to selectively provide a discharge current or voltage to the output of the column driver, when the fourth switch is selected to be closed;

wherein after the third switch provides the partial-discharge current or voltage to the output of the column driver during a partial discharge phase of a first row time period, the second switch provides the pre-charge current or voltage to the output of the column driver, if the first switch is to provide the light emitting current to the output of the column driver during a second row time period immediately following the first row time period, otherwise the fourth switch provides the discharge current or voltage to the output of the column driver if the first switch is to not provide the light emitting current to the output of the column driver during the second row time period.

14. The column driver of claim 13, wherein the third switch and the fourth switch comprise a single switch that is coupled between a discharging current source and the output of the column driver, the partial-discharge current being provided to the output of the column driver when the single switch is closed for only a first time period, the discharge current being provided to the output of the column driver when the single switch is closed for at least a second time period.

15. The column driver of claim 13, wherein:

the first switch is coupled between a light emitting current source and the output of the column driver;

the second switch is coupled between a pre-charge current or voltage source and the output of the column driver;

the third switch is coupled between a partial-discharge current or voltage source and the output of the column driver; and the fourth switch is coupled between a discharge current source or discharge potential and the output of the column driver.

16. The column driver of claim 15, wherein the fourth switch is coupled between a discharge potential and the output of the column driver, and wherein the discharge potential is less than a voltage generated at the output of the column driver when the third switch is selected to provide the partial-discharge current or voltage source to the output of the column driver.

17. The column driver of claim 15, wherein the fourth switch is coupled between a discharge current source and the output of the column driver, and wherein a voltage produced at the output of the column driver when the fourth switch is selected to provide the discharge current source to the output of the column driver for a predetermined amount of time is less than a voltage generated at the output of the column driver when the third switch is selected to provide the partial-discharge current or voltage source to the output of the column driver.

18. The column driver of claim 13, wherein each switch is adapted to be selectively closed in response to a corresponding signal received by a finite state machine.

19. The column driver of claim 13, wherein the output of the column driver is adapted to be coupled to a node that is common to each display element in the column.

20. The column driver of claim 13, wherein each switch includes at least one transistor.

21. The column driver of claim 13, wherein each current source includes at least one transistor.

22. A column driver adapted to drive a column of display elements having a parasitic capacitance, comprising:

a first switch adapted to selectively provide a light emitting signal to an output of the column driver;

a second switch adapted to selectively provide a partial-discharge signal to the output of the column driver; and a third switch adapted to selectively provide a discharge signal to the output of the column driver;

wherein after the second switch provides the partial-discharge signal to the output of the column driver during a partial discharge phase of a first row time period, the third switch provides the discharge signal to the output of the column driver during a second row time period immediately following the first row time period if the first switch is to not provide the light emitting signal to the output of the column driver during the second row time period.

23. The column driver of claim 22, wherein:

the first switch is coupled between a light emitting current source and the output of the column driver;

the second switch is coupled between a partial-discharge current or voltage source and the output of the column driver; and the third switch is coupled between a discharge current or potential and the output of the column driver.

24. The column driver of claim 23, wherein the third switch is coupled between a discharge potential and the output of the column driver, and wherein the discharge potential is less than a voltage generated at the output of the column driver when the second switch is selected to provide the partial-discharge current or voltage source to the output of the column driver.

25. The column driver of claim 23, wherein the third switch is coupled between a discharge current source and the output of the column driver, and wherein a voltage produced at the output of the column driver when the third switch is selected to provide the discharge current to the output of the column driver is less than a voltage generated at the output of the column driver when the second switch is selected to provide the partial-discharge current or voltage source to the output of the column driver.

26. The column driver of claim 22, wherein each switch is adapted to be selectively closed in response to a corresponding signal received by a finite state machine.

27. The column driver of claim 22, wherein the output of the column driver is adapted to be coupled to a node that is common to each display element in the column.

28. The column driver of claim 22, wherein each switch includes at least one transistor.

29. The column driver of claim 22, wherein current source includes at least one transistor.

30. A column driver adapted to drive a column of display elements having a parasitic capacitance, comprising:

a first switch coupled between a first current source and the column, the first switch adapted to provide a light emitting current to the column during a light emitting phase;

a second switch coupled between a second current source and the column, the second switch adapted to cause a partial-discharge of the column during a partial discharge phase; and the second switch further adapted to cause a further discharge of the column during a discharge phase;

wherein after the second switch causes the partial-discharge of the column during the partial-discharge phase of a first row time period, the second switch causes the further discharge of the column during a next row time period immediately following the first row time period if the first switch is to not to provide the light emitting current to the column during the second row time period.

31. The column driver of claim 30, further comprising:

a third switch coupled between a third current source and the column, the third switch adapted to cause a pre-charge of the column during a pre-charge phase.

32. The column driver of claim 30, further comprising:

a third switch coupled between a voltage source and the column, the third switch adapted to cause a pre-charge of the column during a pre-charge phase.

33. A method for driving a row of display elements having a parasitic capacitance, the method comprising:

(a) during a pre-charge phase within a first column time period, pre-charging the row of display elements;

(b) following the pre-charge phase, during a light emitting phase within the first column time period, applying a light emitting current to the row of display elements;

(c) following the light emitting phase, during a partial-discharge phase within the first column time period, partially discharging the row of display elements; and (d) during an initial phase within a second column time period immediately following the first column time period, pre-charging the row of display elements if a light emitting phase is to be performed within the second column time period, otherwise further discharging the row of display elements if a light emitting phase is not to be performed within the second column time period.

* * * * *